United States Patent [19]

Sasaki et al.

[11] 4,307,273

[45] Dec. 22, 1981

[54] GAS BLAST CIRCUIT BREAKER

[75] Inventors: Koji Sasaki; Tuneo Kishi, both of Hitachi, Japan

[73] Assignee: Hitachi, Ltd., Tokyo, Japan

[21] Appl. No.: 23,670

[22] Filed: Mar. 26, 1979

[30] Foreign Application Priority Data

Mar. 24, 1978 [JP] Japan ..... 53-33114
Mar. 31, 1978 [JP] Japan ..... 53-36625

[51] Int. Cl.[3] ..... H01H 33/14; H01H 33/82

[52] U.S. Cl. ..... 200/148 R; 200/145; 200/148 A

[58] Field of Search ..... 200/145, 148 R, 148 A, 200/148 C, 148 D, 148 E, 148 F, 148 G, 150 G

[56] References Cited

U.S. PATENT DOCUMENTS 3,532,843 10/1970 Pucher ..... 200/145 X
3,597,557 8/1971 Floessel ..... 200/148 R
3,903,387 9/1975 Sasaki et al. ..... 200/145 X
4,086,461 4/1978 Gonek ..... 200/145 X
4,105,879 8/1978 Tsukushi et al. ..... 200/148 A

*Primary Examiner*—James R. Scott
*Attorney, Agent, or Firm*—Craig and Antonelli

[57] ABSTRACT

A gas blast circuit breaker comprises one breaking assembly having a supporter and two breaking units at least movable contacts of which are supported on opposite ends of the supporter, and the other breaking assembly having a supporter and a single breaking unit at least a movable contact of which is supported on one end of the supporter. The two breaking assemblies are so arranged as to have only one breaking unit between the two supporters, whereby flows of blasting gas in the three breaking units of the two breaking assemblies can be prevented from interferring with each other.

16 Claims, 6 Drawing Figures

GAS BLAST CIRCUIT BREAKER

BACKGROUND OF THE INVENTION

This invention relates to a gas blast circuit breaker and more particularly, to a gas blast circuit breaker which is suitable for comprising an odd number of circuit breaking units within an enclosed container.

A puffer type gas blast circuit breaker has been known as a high-voltage, large-capacity circuit breaker. The puffer type gas blast circuit breaker generally comprises a breaking unit within an enclosed container filled with an arc extinguishing gas, for example, $SF_6$ gas of a single pressure. The breaking unit has a pair of contacts which are separable relative to each other and a compressing device which compresses the arc extinguishing gas in corelation to the separating action between the paired contacts. The gas thus highly pressurized by the compressing device is blasted at the arc occurring between the contacts to extinguish it.

It is generally required for the high-voltage, large-capacity gas blast circuit breaker to use at least two breaking units constituting one breaking assembly. More particularly, movable contacts of the two breaking units are connected to a common insulator operating rod, and the insulator operating rod is driven by an actuator provided separately so that the two movable contacts are actuated simultaneously.

Accordingly, this type of circuit breaker usually has an even number of breaking units with a few exceptions where a single breaking unit is utilized. For example, a circuit breaker which is of a larger capacity next to a circuit breaker with two breaking units has four breaking units or two breaking assemblies. Such a construction system is advantageous for facilitating the increase or decrease of the capacity of the circuit breaker merely by increasing or decreasing the number of the breaking assemblies.

However, the recent improvements in gas blast circuit breakers and advances in current breaking technology have been very large and this trend has contributed to a rapid improvement in the current breaking capacity of a single breaking unit.

From this background, it may be disadvantageous to construct the circuit breaker of a larger capacity next to the circuit breaker of two breaking units by always assembling such four breaking units. Apart from this reason, there is also a demand for circuit breakers of an intermediate capacity.

Briefly, in the conventional gas blast circuit breaker, two breaking units constitute one breaking assembly. Typically, the assembly is arranged such that a supporter called a bracket is secured to an insulator supporting cylinder which is held stationary with its axis aligned with the radius of a tank or enclosed container, and the movable contacts are supported on opposited ends of the supporter. A single insulator operating rod inserted in the insulator supporting cyclinder is adapted to transmit a switching operation force simultaneously to the movable contacts of the respective two breaking units.

In the case of four breaking units connected in series, for example, two sets of the breaking assemblies are arranged. Each breaking assembly is provided with one insulator operating rod and all of the rods are simultaneously operated by a single actuator. The actuator is connected to the movable contacts through respective operation force transmission mechanisms having substantially the same structure in order to avoid mismatching in switching operation of the breaking units. The operation force transmission mechanism includes the insulator operating rod and a link mechanism which are adapted to mechanically connect the actuator to the movable contacts. More particularly, the link mechanism is disposed between the insulator operating rod belonging to each breaking assembly and the actuator and enclosed in a casing. Accordingly, for the purpose of avoiding mismatching in switching operation of the breaking units, it is desirable to arrange the casings as close as possible to each other.

SUMMARY OF THE INVENTION

A prime object of this invention is to provide a gas blast circuit breaker capable of performing high current breaking capability with a lower number of breaking units.

Another object of this invention is to provide a gas blast circuit breaker capable of being easily adjusted for lower mismatching in switching operation of the breaking units.

Yet another object of this invention is to provide a gas blast circuit breaker with an odd number of breaking units.

According to this invention, the above objects can be accomplished by providing a gas blast circuit breaker comprising in combination a first breaking assembly including two breaking units having at least movable contacts supported on opposite ends of one supporter means and a second breaking assembly including one breaking unit having at least a movable contact supported on one end of a different supporter means, wherein the first and second breaking assemblies are disposed such that there exists no breaking unit between the supporter means other than one of the breaking units. With this construction, blast gas flows respectively associated with the respective breaking units will not interfere with each other so that it is possible to provide the gas blast circuit breaker capable of performing high breaking capability with a lower number of breaking units.

DESCRIPTION OF THE PREFERRED EMBODIMENTS

Figure 1:
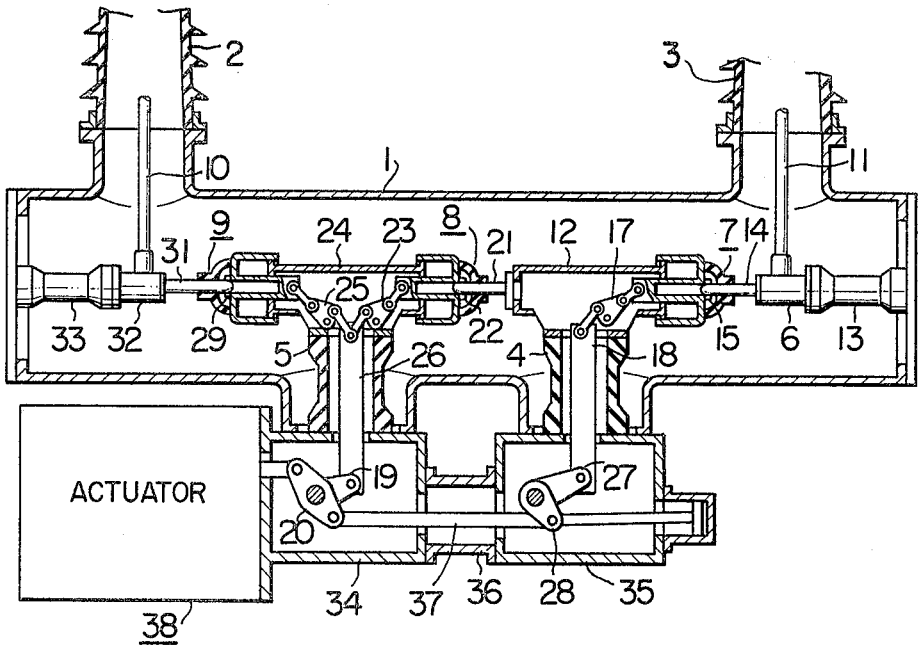
FIG. 1 is a longitudinal sectional view of an embodiment of a gas blast circuit breaker in accordance with the invention.

FIG. 1 shows, in longitudinal section, a puffer type gas blast circuit breaker. Within a tank 1 filled with an arc extinguishing gas, for example, $SF_6$ gas are arranged three breaking units 7, 8 and 9 which are electrically connected in series. The tank 1 is made cylindrical and connected with radial bushings 2 and 3 near the opposite ends. The opposite ends of the series connection of breaking units 7, 8, 9 are respectively connected to central conductors 10 and 11 extending in the bushings 2 and 3. The bushings 2 and 3 may otherwise be replaced by gas i nsulator buses. The central conductor 10 is secured to a conductor 32 which in turn is secured to an insulator supporter 33 held in stationary in the axial direction of the tank 1. Similarly, the central conductor 11 is secured to a conductor 6 which in turn is secured to an insulator supporter 13. Stationary contacts 14 and 31 of the breaking units 7 and 9 are secured to the conductors 6 and 32, respectively.

The breaking units 8 and 9 constitute one breaking assembly. Movable portions of the breaking units 8 and 9 have movable contacts 22 and 29 which are supported on opposite ends of a common supporter 24 which in turn is secured to an insulator supporting cylinder 5. Within the supporter 24 are arranged link mechanisms 23 and 25 which are respectively connected at one end with the movable contacts 22 and 29 and at the other end with one end of an insulated operating rod 26.

The other breaking assembly comprises a supporter 12 which supports at one end opposite to the supporter 24 a movable contact 15 of the breaking unit 7. The supporter 12 is secured to an insulator supporting cylinder 4 which is held stationarily with a predetermined spacing from the insulator supporting cylinder 5. One end of the supporter 12, adjacent the supporter 24, firmly supports a stationary contact 21 of the breaking unit 8 and the other end, oppositing to the supporter 24, supports a movable portion of the breaking unit 7 including the movable contact 15. This movable portion is connected to one end of a link mechanism 17 of which the other end is connected to an insulator operating rod 18.

In this manner, the three breaking units 7, 8 and 9 are substantially aligned in a line along the axial direction of the tank 1.

The insulator operating rods 18 and 26 are respectively connected to links 19 and 27 reotatably mounted within casings 34 and 35. Links 20 and 28 pivotable in common with the links 19 and 27, respectively, are connected with a rod 37. Thus, clockwise rotations of the links 20 and 28 cause the insulator operating rod 18 and the link 17 as well as the insulator operating rod 26 and links 23 and 25 to move for separating the movable contact 15 as well as the movable contacts 22 and 29 from the associated stationary contact. On the other hand, counterclockwise rotations of the links 20 and 28 move the movable contacts 15, 22 and 29 to close the circuit. An actuator 38 is provided for giving such rotations of the links 20 and 28. Between the casings 34 and 35, each having a definite size determined depending on the mechanism, is interposed a pipe 36 surrounding the rod 37, which pipe prevents the casing 35 from being displaced by a force imparted thereto from the actuator 38. Accordingly, it is desirable that the pipe 36 be made of a strong material and have an axial length as small as possible. In a preferred embodiment shown in FIG. 1, the breaking unit 7 is supported by the supporter 12 at one end thereof remote from the breaking unit 8. This construction can decrease the axial length of the rod 37 lying between the insulator operating rods 18 and 26, resulting in reduction in the axial length of the pipe 36. This effect is more satisfactory than can be expected from mere removal of one breaking unit from four breaking units of the circuit breaker. In addition, the arrangement of the breaking unit 7 not facing, or remote from the breaking unit 8 has advantages as described below.

As well known in the art, the breaking unit of puffer type has a compressing device which compresses the arc extinguishing gas in corelation to the separating action of the paired contacts. The compressing device includes a cylinder and a piston in combination, one being stationary and the other movable. The gas compressed by the compressing device is blasted to the arc taking place between the contact and is then discharged into the atmosphere inside the tank 1. Accordingly, in order to maintain insulation near the breaking unit, for example, between the contacts of opposite poles, it is necessary to properly treat the after-gas which may have a low dielectric strength due to reaction with the arc. Specifically, it is desired that the breaking units are substantially not affected by the after-gases which have been applied to extinguishing the arc in the adjacent breaking units for the sake of maintaining the insulation between their contacts against a recovery voltage appearing across the contacts after the arc has been extinguished. From this standpoint of view, the construction illustrated in FIG. 1 is advantageous because the breaking unit 7 is arranged on the righthand side of the supporter 12, without directly facing the breaking unit 8, so that the after-gas having participated in extinguishing the arc in the breaking unit 8 never affects the breaking unit 7 or vice versa. The same effect might be attained by arranging the breaking unit 7 on the other side of the supporter 12 closer to the breaking unit 8 if a sufficiently large distance is provided between the breaking units 7 and 8. In such a case, however, the axial lengths of rod 37 and tank 1 become longer, resulting in the following defects.

More particularly, the breaking unit 7 is incorporated with the compressing device which is required to produce a large force for separating the contacts from each other, which in turn applies a large tension to the rod 37 resulting in an elongation thereof correspondingly. This elongation leads to a delay in operation of the breaking unit 7 with respect to operations of the breaking units 8 and 9 and as a result, time-consuming work is required for correction of the delay. If the rod 37 were made unsusceptible to the force by increasing the cross sectional area of the rod 37, this would invite the adverse effect of increasing the load on the actuator 38. The construction shown in FIG. 1, on the contrary, ensures a shorter axial length of the rod 37, as well as easy adjustment for eliminating mismatching in operating times of the breaking units 7, 8 and 9.

Overall construction as illustrated in FIG. 1 is also advantageously laid out. Attention should be paid to the location of the actuator 38. The actuator 38 is located nearer to the breaking assembly including the two breaking units 8 and 9, than to the other breaking assembly having the breaking unit 7. In other words, the breaking assembly having one breaking unit is located remote from the actuator. For this reason, the breaking assembly imparting a large load to the actuator 38 is closer to the actuator than the other breaking assembly imparting a small load to the actuator 38 so that the rod 37 can be thin and light.

Figure 2:
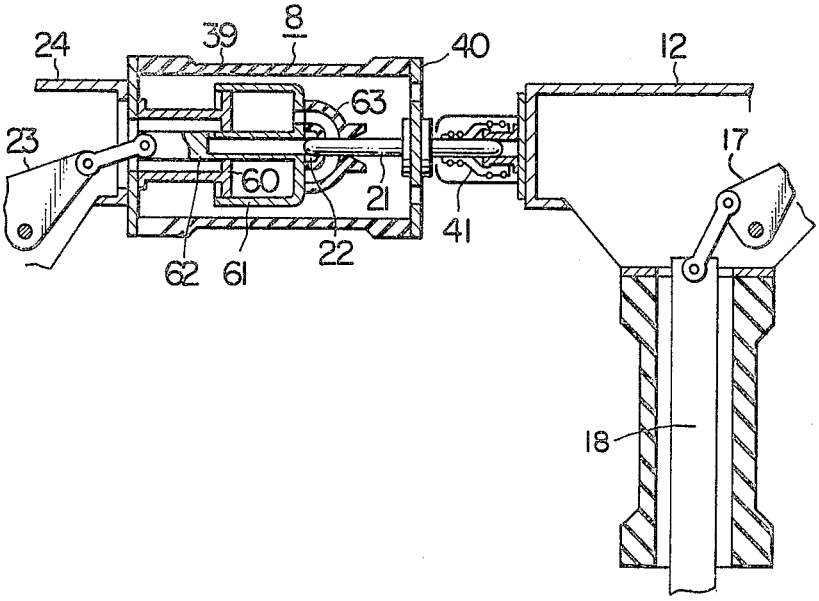
FIG. 2 is a longitudinal sectional view of another embodiment of the invention, as illustrated by partially joining FIG. 1.

FIG. 2 shows an essential part of another embodiment of the invention. This embodiment is substantially the same as the previous embodiment except for the supporting structure for the stationary contact. Since the breaking units generally have the same constructions as those of FIG. 1, this embodiment will describe only those portions corresponding to the breaking unit 8 of FIG. 1.

Secured to a supporter 24 is one end of an insulator cylinder 39. To a free end of the insulator cylinder 39 is secured an end plate 40 to which a stationary contact 21 is secured. A breaking unit within the insulator cylinder 39 has the same construction as that of FIG. 1. The stationary contact 21 is electrically connected to a supporter 12 through a contact 41, for example, which may be replaced by a flexible conductor. If this illustrated construction of the breaking unit 8 is applied to each breaking unit having a pair of contacts all the breaking units may be supported by only the supporters 12 and 24, whereby the insulator supporters 13 and 33 as shown in FIG. 1 can be omitted. In place of the insulated cylinder 39, an impedance device may be used. The impedance device herein referred to stands for a voltage divider for providing uniform voltage distribution among the breaking units, or a resistor throwing-in device for suppressing a surge appearing when closing the circuit. Construction of a puffer type breaking unit will be understood from FIG. 2. A compressing device includes a piston 60 and a cylinder 61. The piston 60, which is stationary, is fixed to the supporter 24 and the cylinder 61, which is movable, is connected to a movable contact 22. The movable part including the movable contact 22 is connected to a link mechanism 23 by way of a central shaft 62. When the movable contact 22 is driven by the link mechanism 23 to separate from the stationary contact 21, an arc extinguishing gas confined within a chamber defined by the piston 60 and cylinder 61 is compressed. The compressed gas is guided by an insulator nozzle 63 and then blasted to an arc taking place between the contacts 21 and 22, thereby extinguishing the arc.

The insulator operating rod 18 shown in FIG. 1 is connected to the movable part of the breaking unit 7 so that the insulator operating rod 18 shares the load of the compressing device of the breaking unit 7. Since the movement of the insulator operating rod 18 in the radial direction of the tank 1 is transmitted to the movement of the movable part of the breaking unit 7 in the axial direction of the tank 1, some excess force is required for operation of the insulator operating rod 18. This excess force can be reduced in a further embodiment to be described below.

Figure 3:
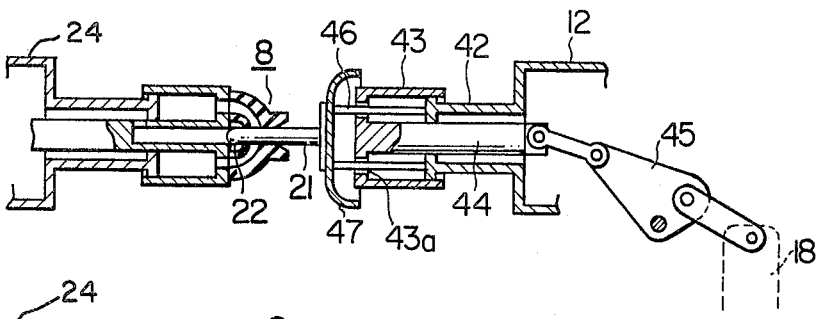
FIGS. 3 and 4 are partial longitudinal sectional views of further embodiments of the gas blast circuit breaker in accordance with the invention.

In an embodiment as shown in FIG. 3, a dummy load generating device is provided at one end of the supporter 12 opposite to a breaking unit 7. This dummy load generating device includes a piston 42 secured to the supporter 12 and a cylinder 43 which is slidable along the piston 42, which in combination act as a compressing device. A central shaft 44 of the cylinder 43 is connected to one end of a link mechanism 45, the other end of which is connected to the insulator operating rod 18. One end of the cylinder 43, opposing to a breaking unit 8, is formed with an opening 43*a* through which a connecting rod 46 passes. The connecting rod 46 has one end secured to the piston 42 and the other end secured to a deflector 47. The deflector 47 functions to urge a gas compressed by the piston 42 and cylinder 43 toward the supporter 12. Secured to the deflector 47 is a stationary contact 21 of the breaking unit 8.

When the insulator operating rod 18 is driven downward as viewed in FIG. 3, the movable contact 15 of the breaking unit 7 is separated from the stationary contact 14 and at the same time the cylinder 43 is moved toward the supporter 12. The piston 42 and cylinder 43 are designed to constitute a compressing device having the same construction as that of the compressing device of the breaking unit 7 so that both the compressing devices compress gases substantially at the same pressure rising rate. In this manner, the insulated operating rod 18 is imparted with loads of substantially the same force in opposite directions along the center axis of the supporter. As a result, the operating rod is effectively imparted with its axial component force alone, and not with a force deviating it from the axial direction. The compressed gas from the compressing device including the piston 42 and cylinder 43 jets out of the opening 43*a* and is then guided by the deflector 47 toward the supporter 12. This gas flows in the same direction as that of the after-gas which has participated in extinguishing the arc in the breaking unit 8 and aids filling the vicinity of the contacts 21 and 22 with a fresh gas. Consequently, the compressing device for applying the dummy load to the insulator operating rod 18 also improves insulation recovery characteristic between the contacts 21 and 22.

Figure 4:
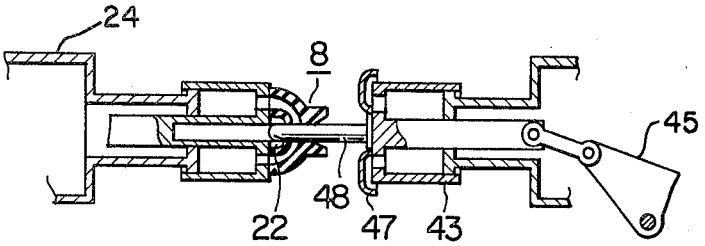

A modified embodiment shown in FIG. 4 further improves the embodiment of FIG. 3. In this embodiment, the supporters for the stationary contact 21 of the breaking unit 8 and for the deflector 47 are modified. A contact 48, corresponding to the stationary contact 21 in FIG. 3, is secured to a cylinder 43. Accordingly, paired contacts 22 and 48 are moved in opposite directions to separate from or contact with each other, thereby increasing the relative speed in separation. This construction is particularly effective to improve breaking capability for interrupting a small leading current which is usually accompanied by a high recovery voltage. A deflector 47 secured to the cylinder 43 acts like the deflector 47 of FIG. 3.

It should be appreciated that the embodiments of FIGS. 3 and 4 have the single breaking unit with the movable portion secured to the supporter 12. The compressing device including piston 42 and cylinder 43 includes no separable contacts and hence cooperates with no other breaking unit. Accordingly, the axial length of this dummy load generating device is small, attaining a similar effect to the FIG. 1, embodiment.

Also, as the dummy load generating device, a spring mechanism or the like may be used. In the foregoing embodiments, the cylindrical tank 1 is employed to constitute the enclosed container but the enclose container may be made in any other suitable shape. Furthermore, the breaking units may be arranged obliquely with respect to the insulated supporting cylinder 4 or 5 to form a V-shaped breaking assembly.

Figure 5:
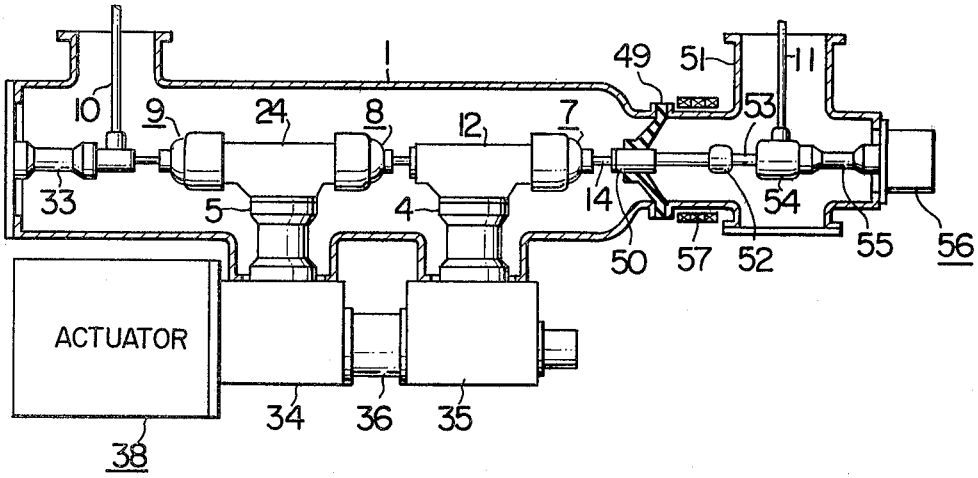
FIGS. 5 and 6 are side views, partly in section, of still further embodiments of the gas blast circuit breaker in accordance with the invention.

FIG. 5 shows a further embodiment of a puffer type gas blast circuit breaker of which the elements contained in the tank are made up of substantially the same construction as that of FIG. 1. Like components are designated by like reference numerals and are not described in more detail.

A stationary contact 14 of a breaking unit 7 is secured to a central conductor 50 supported by an insulating spacer 49 sealing one end of the tank 1. A disconnector enclosing container 51 is connected to the tank 1 with the spacer 49 interposed therebetween. Within the container 51 is arranged a disconnector having a stationary contact 52 and a movable contact 53. The stationary contact 52 is secured to the central conductor 50 supported by the insulating spacer 49. The movable contact 53 is in permanent contact with a collector 54 and separable from the stationary contact 52. The collector 54 is supported within the disconnector enclosing container 51 by means of an insulator cylinder 55 in which an insulator operating rod is disposed to be driven by an operating device 56. The movable contact 53 is connected to the insulator operating rod. The collector 54 is connected to a central conductor 11. Since the stationary contact 52 of the disconnector is secured to the insulating spacer 49 which prevents gas communication between the tank 1 and the disconnector enclosing container 51, it is possible to decrease the necessary number of insulator supporting members.

FIG. 5 shows a transformer 57 mounted on the disconnector as surrounding the stationary contact 52. Further, the disconnector is connected to the breaking assembly having a single breaking unit 7. If the disconnector were disposed adjacent to the breaking unit 9, the actuator 38 would invite inconvenience in work for connecting or disconnecting the disconnector enclosing container 51 to the tank 1. With the construction shown in FIG. 5, the work for assembling and disassembling the disconnector enclosing container 51 to the tank 1 will not be disturbed by the actuator 38 and therefore can be done easily.

Figure 6:
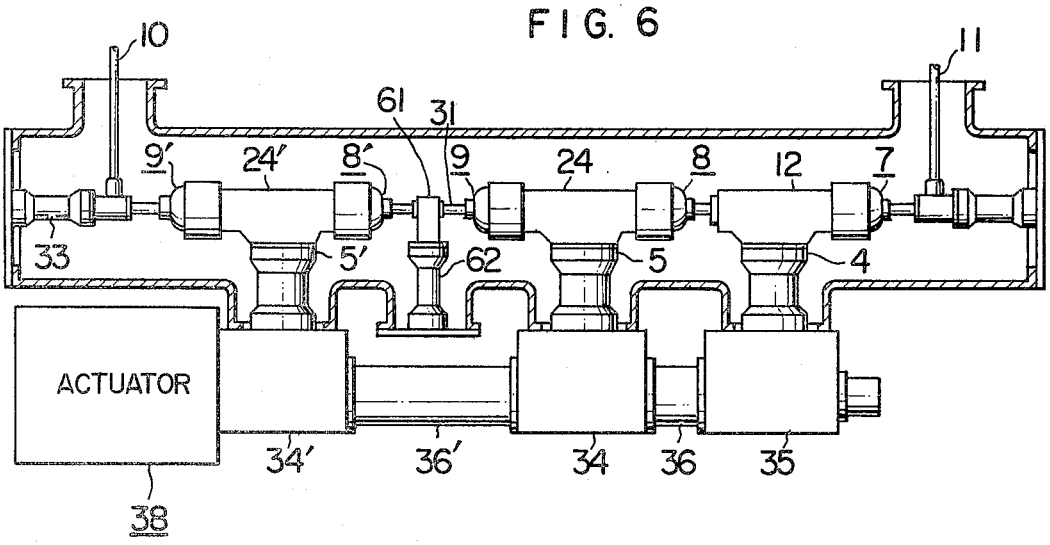

In connection with the foregoing embodiments, the gas blast circuit breaker is described to have three breaking units 7, 8 and 9. This invention, however, is also applicable to a circuit breaker having more than three breaking units. In an embodiment shown in FIG. 6, the circuit breaker comprises five breaking units of which three braking units 7, 8 and 9 are substantially the same in construction as those of FIG. 1, except that a stationary contact 31 of the breaking unit 9 is secured to a conductor 61 which in turn is secured to an insulator supporter 62. The embodiment of FIG. 6 is different from the embodiment of FIG. 1 in that the former includes an additional breaking assembly having a supporter 24′ and two breaking units 8′ and 9′ supported at both ends of the supporter 24′ and secured to an insulator supporter 5′. In compliance with the additional breaking assembly, a pipe 36′ and a casing 34′ are added between the casing 34 and the actuator 38.

This construction may have some difficulties with the gas flow between the breaking units 8′ and 9. If the distance between breaking units 8′ and 9′ is kept relatively large to meet the gas flow problem, it is possible to decrease the overall axial length of the circuit breaker by constructing the breaking assembly with the breaking unit 7 in a similar manner to the embodiment of FIG. 1. The embodiment of FIG. 6 also attains substantially the same effects as those of the embodiment in FIG. 1.

We claim:

1. A gas blast circuit breaker comprising:

an enclosing container filled with an arc extinguishing gas;

first and second insulator supporting cylinders mounted in said container with a predetermined spacing therebetween, each having a first end fixed to said container and a second end disposed within said container;

first and second support means fixed to said second ends of said first and second insulator supporting cylinders, respectively;

first and second link mechanisms supported by said first and second support means, respectively;

first and second insulator operating rods extending in said first and second insulator supporting cylinders, respectively, and each connected at a first end to a first end of said link mechanism;

driving means operatively connected to both second ends of said first and second insulator rods so as to simultaneously operate said first and second link mechanisms;

first, second and third breaking units mounted in said enclosing container and each including contact means having first and second contacts operative to close and open therebetween and compressor means for producing a compressed arc extinguishing gas and for blasting said compressed gas to said contact means in response to the opening of said contacts, said first breaking unit is supported and disposed between said first and second support means, said second and third breaking units are supported and disposed at ends of said first and second support means opposite said first breaking unit, respectively;

a balancing load providing unit disposed between said first breaking unit and said second support means and having compressor means whose capacity substantially the same as that of the compressor means of said breaking units;

first connecting means for operatively connecting said second contact of said first and second breaking units to a second end of said first link mechanism; and second connecting means for operatively connecting said second contact means of said third breaking unit and said compressor means of said balancing load providing unit to a second end of said second link mechanism so as to restrict imbalance between respective loads of said third breaking unit and said balancing load providing unit applied to said link mechanism of said second breaking unit.

2. A gas blast circuit breaker comprising:

an enclosing container filled with an arc extinguishing gas, first and second support means arranged with a predetermined spacing therebetween within said enclosing container, first and second insulating support means for supporting said first and second support means respectively, a first breaking unit arranged between and supported by ends of said first and second support means so as to electrically connect said first and second support means, a second breaking unit supported on an end of said second support means remote from said first support means, a third breaking unit supported on an end of said first support means remote from said second support means, and said breaking units having a first and second contacts operable to open and close, said first contact being associated with a cylinder means, said second contact being associated with a piston means, thereby forming a compressor means for blasting an arc extinguishing gas between said first and second contacts when opened, a first link mechanism arranged within said first support means having first ends connected to said second contact of said first and third breaking units, a first insulator rod arranged within said first insulating support means having a first end operatively connects to a second end of said first link mechanisms, a second link mechanism arranged with said second support means having a first end connected to said second contact of said second breaking unit, a second insulator rod arranged within said second insulating support means having a first end operatively connected to a second end of said second link mechanisms, an actuator operably connected to second ends of said insulator rods for simultaneously opening and closing said first and second contacts of said first, second and third breaking units.

3. A gas blast circuit breaker according to claim 2, wherein said first contact of said first breaking unit is mechanically secured to said second support means, and said second contact of said first breaking unit is movably supported by said first support means.

4. A gas blast circuit breaker according to claim 2, wherein an insulator cylinder is interposed between and secured by said first and second support means, said first contact of said first breaking unit is secured to an end of said insulator cylinder adjacent the second support means, and said second contact of said first breaking unit is movably supported by said first support means within said insulator cylinder.

5. A gas blast circuit breaker according to claim 2, wherein said actuator is connected to said first insulator rod by a first link means, said first link means is operably connected to a second link means and to the second insulator rod by a rod, said rod is slidably mounted in a casing means surrounding said second link means and the second insulator rod opposite said first link means.

6. A gas blast circuit breaker according to claim 2, wherein a balancing load unit is provided between and secured to said first breaking unit and said second support means for providing a force in a direction opposite that for the opening of said first and second contacts of said second breaking unit.

7. A gas blast circuit breaker according to claim 6, wherein said balancing load unit has a balancing compressor means whose compressing capacity is substantially the same as that of said compressor means of said breaking units, and first and second connecting means are provided for connecting the second contacts of said first, second and third breaking units to said first ends of said first and second link mechanisms, respectively.

8. A gas blast circuit breaker according to claim 7 or 1, wherein the second contact said first breaking unit is connected through said first connecting means to said second end of said first link mechanism and the first contact of said first breaking end is operatively connected to said balancing load providing unit so as to move with operation of said compressor means, so that the first and second contacts of said first breaking unit are movable simultaneously towards their open or closed position when said first and second link mechanisms are operated.

9. A gas circuit breaker according to claim 7 or 1, wherein said balancing compressor means further comprises guide means for guiding a compressed gas towards said second support means so as to aid filling a vicinity of said first and second contacts of said first breaking unit with fresh gas.

10. A gas blast circuit breaker according to claim 7 or 1 wherein said balancing compressor means comprises a piston and a cylinder, one of which serves as a stationary component and the other of which serves as a movable component, and means for guiding an arc extinguishing gas compressed by said balancing compressor means towards said second support means.

11. A gas blast circuit breaker according to claim 2, further comprising a casing for housing the first, second and third breaking units and their respective link means and insulator rods, and the actuator, a second enclosing container fitted to an opening of said enclosed container near said third breaking unit, an insulator spacer preventing gas communication between said enclosing and said second enclosing containers and supporting a stationary second contact of said third breaking unit, a circuit breaker arranged within said second enclosing container and having a pair of separable contacts, and a second actuator operably connected to a first contact of said circuit breaker.

12. A gas blast circuit breaker according to claim 11, wherein said second contact of said circuit breaker is secured to said insulator spacer.

13. A gas blast circuit breaker according to claim 2, further comprising, a third support means arranged at a predetermined distance from the first support means opposite said second support means, a third insulator support means for supporting said third support means, a fourth breaking unit arranged between said first and third support means and supported by said third insulator support means, a fifth breaking unit arranged at and supported by said third support means opposite said fourth breaking unit, means for electrically connecting said third and fourth breaking units supported by an insulator supporter, said fourth and fifth breaking units having first and second contacts operable to open and close, said contacts being associated with a compressor means for blasting an arc extinguishing gas between said first and second contacts when opened, a third link mechanism having a first end connected to said second contacts of said forth and fifth breaking units, respectively;

a third insulator rod having a first end operatively connected to a second end of said third link mechanism, said actuator operably connecting the second end of said third insulator rod for simultaneously opening and closing said first and second contacts of said first, second, third, fourth and fifth breaking units.

14. A gas blast circuit breaker comprising:

an enclosing container filled with an arc extinguishing gas, first and second support means arranged with a predetermined spacing therebetween within said enclosing container, first and second insulator supporting cylinders for supporting said first and second support means, respectively, a first breaking unit arranged between said first and second support means and having a movable contact switchably supported on said second support means, a second breaking unit supported on one end of said second support means remote from said first support means and having a movable contact switchably supported on said second support means, a third breaking unit supported on one end of first support means remote from said second support means and having a movable contact switchably supported on said first support means, a first insulator operating rod arranged within said first insulator supporting cylinders supporting said first support means and having a first end operably connected to the movable contacts of said first and third breaking units, a second insulator operating rod arranged within said second insulator supporting cylinders supporting said second support means and having a first end operably connected to the movable contact of said second breaking unit, a common actuator connected to a second end of the respective first and second insulator operating unit, dummy load generating means supported on the other end of said second support means opposing to said first end of said second insulator operating rod, said dummy load generating means providing a load which restricts a load of said second breaking unit on said second insulator operating rod from biasing said second insulator operating rod.

15. A gas blast circuit breaker according to claim 14 wherein said first breaking unit comprises said movable contact, a second contact opposing to said movable contact and separable relative thereto, compressing means for compressing the arc extinguishing gas in cooperation with the separation between said contacts, and means for blasting the compressed arc extinguishing gas to an arc taking place between said contacts, said dummy load generating means comprises second compressing means having a piston and a cylinder, one of which serves as a stationary component and the other of which serves as a movable component, and means for guiding an arc extinguishing gas compressed by said second compressing means toward said first support means, and said second contact is secured to said movable component of said dummy load generating means.

16. A gas blast circuit breaker according to claim 14 wherein said first breaking unit comprises said movable contact, a stationary contact opposing to said movable contact, compressing means for compressing an arc extinguishing gas in correlation to the separation between said contacts, and means for blasting the compressed arc extinguishing gas at an arc taking place between said contacts, said dummy load generating means comprises second compressing means having a piston and a cylinder, one of which serves as a stationary component and the other of which serves as a movable component, and means for guiding an arc extinguishing gas compressed by said second compressing means toward said first support means, and said stationary contact is secured to said stationary component of said dummy load generating means.

* * * * *